US005468127A

United States Patent [19]

Elliott et al.

[11] Patent Number: 5,468,127

[45] Date of Patent: Nov. 21, 1995

[54] PILOT CONTROL VALVE HAVING MEANS FOR RECOVERING EXHAUST FLUIDS

[75] Inventors: Andrew C. Elliott, New Orleans; Ray A. Guccione, Marrero, both of La.

[73] Assignee: CheckPoint Fluidic Systems International Ltd., New Orleans, La.

[21] Appl. No.: 381,557

[22] Filed: Jan. 31, 1995

[51] Int. Cl.[6] ..... F04B 9/08; F15B 9/08

[52] U.S. Cl. ..... 417/53; 417/390; 417/403; 91/313; 91/350; 91/308; 137/106; 137/624.14

[58] Field of Search ..... 417/390, 401, 417/403; 91/304, 308, 313, 350; 137/106, 624.14, 625.63

[56] References Cited

U.S. PATENT DOCUMENTS

| | | | |
|---|---|---|---|
| 2,990,910 | 7/1961 | Kimmell | 55/257.1 |
| 3,374,713 | 3/1968 | Broughton | 91/312 |
| 4,776,773 | 10/1988 | Quartana, III | 417/390 |

*Primary Examiner*—Richard A. Bertsch
*Assistant Examiner*—Peter G. Korytnyk
*Attorney, Agent, or Firm*—George A. Bode

[57] ABSTRACT

A pilot control relay valve to change the directional flow of fluid to a piston (such as, for example, the piston of a chemical injection pump for injecting chemicals at a slow or rapid rate over a long period of time), but also allow the recovery of exhaust fluids under significant back pressure. The pilot control relay valve comprises an elongated valve member shiftable within a valve body between a first and second position. The first position allows communication of control fluid to a first pressure receiving surface while allowing exhausting of fluid from a third or opposing pressure receiving surface, thereby to initiate movement of the valve member against the back pressure of the exhaust fluid from its first position to a position equalizing the pressure acting on a second pressure receiving surface with the pressure of the control fluid, thereby causing the valve member to move to its second position. The valve member when it is in its second position allows communication with the third pressure receiving surface while allowing exhausting of fluid from the first pressure receiving surface for initially moving the valve member against the back pressure of the exhaust fluid from its second position while equalizing the pressure acting on the second pressure receiving surface to move the valve member to a position equalizing the pressure acting on the second pressure receiving surface with a pressure lower than the pressure of the control fluid for moving the valve member from its first position, whereby the operation is repeated ad infinitum. Piping is connected to threaded exhaust ports in the valve body to communicate exhaust fluid to a reservoir where it is collected under pressure for further use.

28 Claims, 7 Drawing Sheets

(REFLECTS RRIOR ART; FOR ILLUSTRATIVE PURPOSES)

PILOT CONTROL VALVE HAVING MEANS FOR RECOVERING EXHAUST FLUIDS

BACKGROUND OF THE INVENTION

1. Field of the Invention

The present invention relates to pilot control relay valves having means for recovering exhaust fluids, particularly gasses. Even more particularly, the present invention relates to a pilot control relay valve employed not only to change the directional flow of fluids to a piston, valve or the like wherein controls provide a fluid signal to drive an end device, such as a chemical injection pump to inject chemicals at a slow or rapid rate over a long period of time, but to recover exhaust gases without the adverse effects of back pressure.

2. General Background

Various devices are known which attempt to control a reciprocating pump. Devices of one such type are used in attempting to control a glycol pump which controls the level of liquid in a gas-liquid system and for circulating liquid in a gas-liquid system. These devices require a separate pump and pilot assembly such as that illustrated in U.S. Pat. No. 2,990,910 entitled "Apparatus And Method For Circulating Controlling Liquids In Gas-Liquid Systems" issued to G. 0. Kimmell. Most pertinent, however, is U.S. Pat. No. 4,776,773 entitled "Pilot Control Valve For Controlling The Pumping Rate of An Injection Pump" issued to A. J. Quartana, III. However, Mr. Quartana's teaching contemplates aspiration of the control fluid to atmosphere (ambient) pressures, even more particularly to outside air. As such, Mr. Quartana's teaching is structurally incapable of recovering any exhaust fluids even though it relieves pressure on the output or "low" side and increases pressure on the input or "high" side, thereby allowing the pump to reach a low speed or pumping rate. Exhaust fluid recovery is highly significant and desirable when the control fluid used is environmentally hazardous or a pollutant gas, as is the case with natural gas and "sour" ($H_2S$ impregnated) gas among others. Such usage is commonplace in many parts of the world where natural gas exists under pressure and offers a ready source of motive energy. Further usefulness of gas recovery can be seen in applications where a gas-driven device is housed indoors and the user would wish to prevent gas buildup and possible explosion hazard.

SUMMARY OF THE PRESENT INVENTION

The present invention provides a pilot control relay valve to not only change the directional flow of fluid to a piston such as the piston of a chemical injection pump for injecting chemicals at a slow or rapid rate over a long period of time, but also allow the recovery of all exhaust fluids under significant back pressure. The pilot control relay valve comprises an elongated valve member shiftable within a valve body between a first and second position. The first position allows communication of control fluid to a first pressure receiving surface while allowing exhausting of fluid from a third or opposing pressure receiving surface, thereby to initiate movement of the valve member against the back pressure of the exhaust fluid from its first position to a position equalizing the pressure acting on a second pressure receiving surface with the pressure of the control fluid, thereby causing the valve member to move to its second position. The valve member when it is in its second position allows communication with the third pressure receiving surface while allowing exhausting of fluid from the first pressure receiving surface for initially moving the valve member against the back pressure of the exhaust fluid from its second position while equalizing the pressure acting on the second pressure receiving surface to move the valve member to a position equalizing the pressure acting on the second pressure receiving surface with a pressure lower than the pressure of the control fluid for moving the valve member from its first position, whereby the operation is repeated ad infinitum. Piping is connected to threaded exhaust ports in the valve body to communicate exhaust fluid to a reservoir where it is collected under pressure for further use.

It is therefore, an object of the present invention to allow recovery of exhaust fluids at ambient as well as at significant back pressure conditions while performing work, such as pumping chemicals as illustrated with the present invention.

BRIEF DESCRIPTION OF THE DRAWING

For a further understanding of the nature and objects of the present invention, reference should be had to the following description taken in conjunction with the accompanying drawing in which like parts are given like reference numerals and, wherein:

FIG. 1 is an exploded view of the pilot control relay valve of the apparatus of the present invention with:

DETAILED DESCRIPTION OF THE PREFERRED EMBODIMENT

Figure 1A:
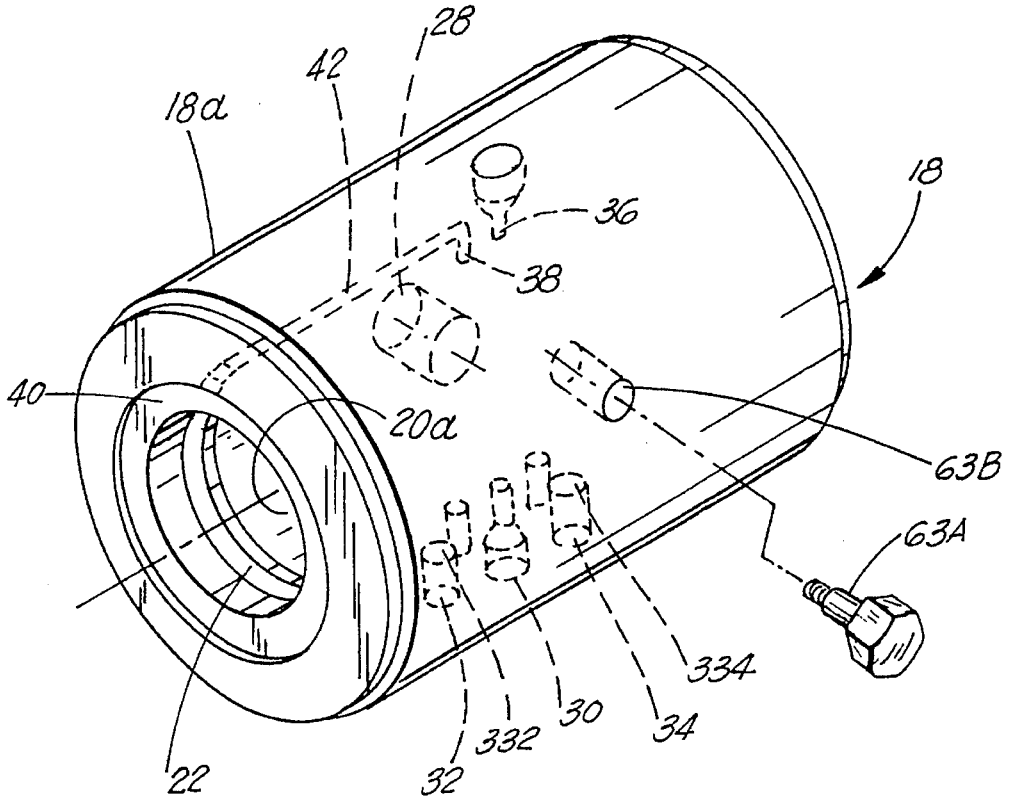
FIG. 1A being a perspective view of the valve housing of the apparatus of the present invention.

Referring now more specifically to the drawing, reference numeral 10 is used to generally designate the pilot control relay valve comprising the present invention. As will be appreciated from FIGS. 3–7, pilot control relay valve 10, in the contemplated environment, will be positioned to be coupled to the valve stem 12 of an actuating piston 14 utilized, for example, in a conventional chemical injection pump 16 to be able to pump at a slow or rapid rate over a long period of time, but recover exhaust gases under significant back pressure without stalling the pump.

Referring now to FIGS. 1A, 1B and 3–7, pilot control relay valve 10, in the contemplated environment, will be positioned to be coupled to the valve stem 12 of an actuating piston 14, utilized in a conventional chemical injection pump 16, and a gas recovery means 200 for recovering exhaust fluids to be able to pump at a slow or rapid rate over a long period of time, but recover exhaust gases without the adverse effects of back pressure.

Figure 1B:
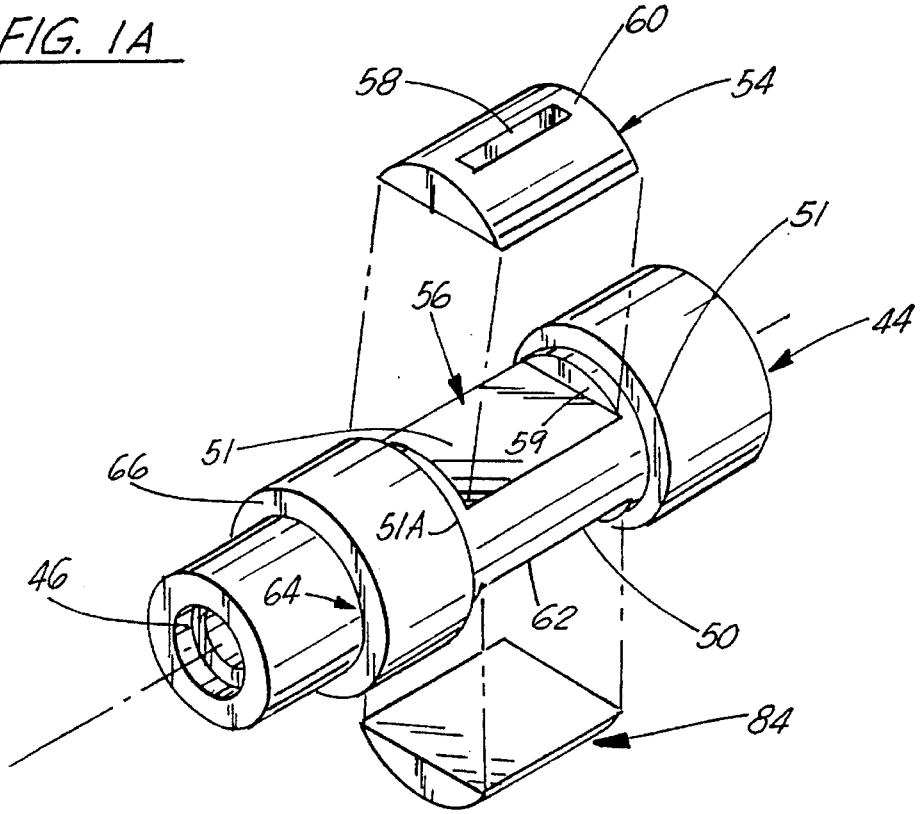
FIG. 1B being a perspective view of the valve member of the apparatus of the present invention.
Figure 2:
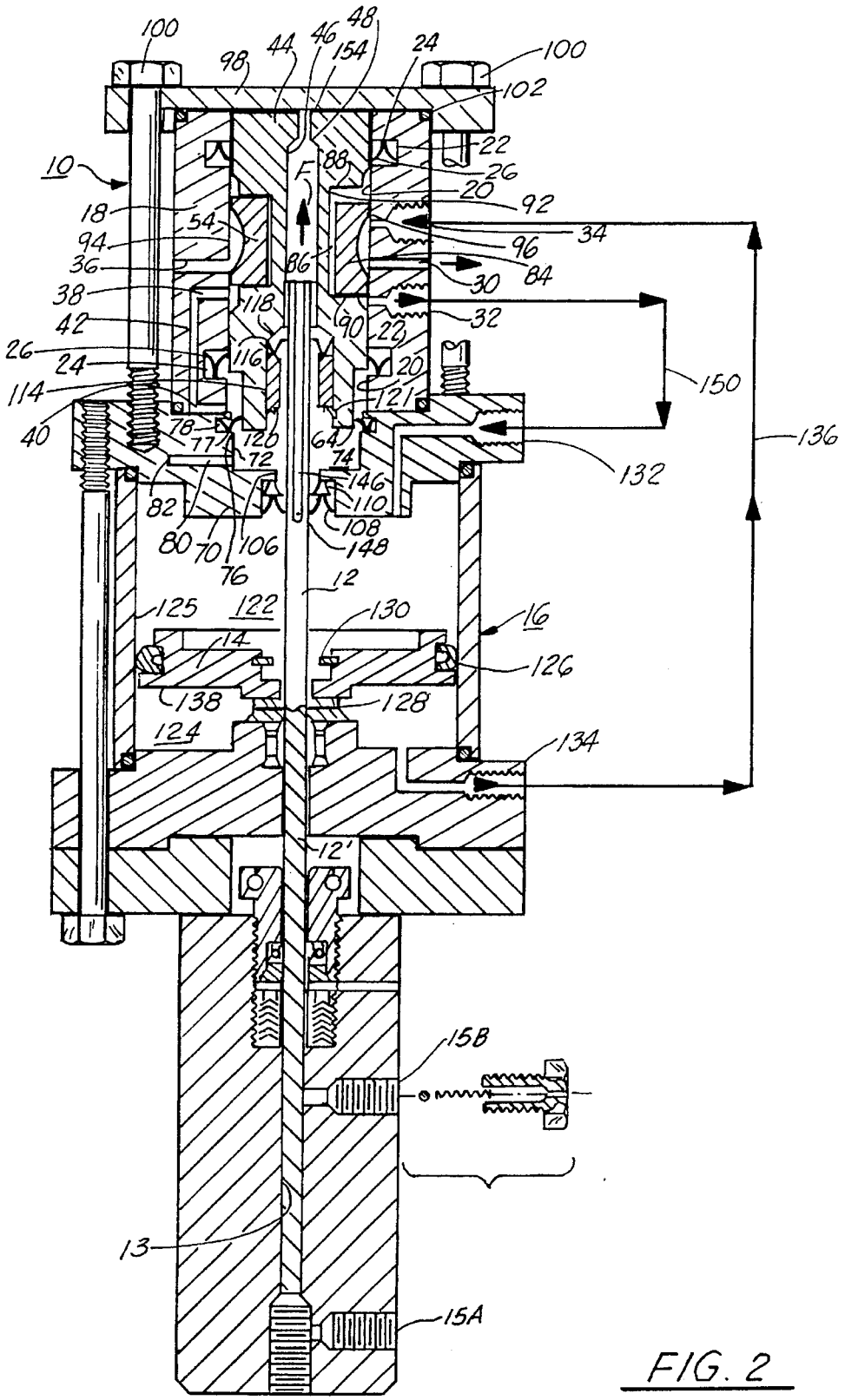
FIG. 2 is a vertical cross-sectional view through the valve of the prior art invention of Mr. Quartana's U.S. Pat. No. 4,776,773 (identical to FIG. 2 of that patent) adapted to a chemical injection pump (for illustrative purposes only) with the valve member shifted to a position at the end of its upstroke (also the position of FIG. 6 of Quartana, III '773).

Referring now to FIGS. 1 and 3–6, pilot control relay valve 10 (as also illustrated in FIG. 2 and described in Mr. Quartana's U.S. Pat. No. 4,776,773 which is incorporated as if fully set out herein) includes an elongated body or valve housing 18 having a central longitudinal bore 20 which is cylindrical and extends through body 18. At each end of valve body 18 there is provided in bore 20 an annular groove 22 incorporating an annular cup seal 24. Cup seals 24 are located in grooves 22 with their annular wiper arms 26 facing each other or facing away from the ends of bore 20.

Intermediate the ends of elongated body 18 are provided threaded ports 28, 30, 32, 34 and 36 which extend radially or laterally through valve body 18 and provide communication between bore 20 and either a source of supply or control fluid, an end device such as chemical injection pump 16 or gas recovery means 200 for recovering exhaust fluids as described further herein.

There is further provided in valve body 18 a pair of radial or lateral passageways 38, 40 which extend radially from the surface of bore 20 into elongated body 18. Bores 38 and 40 are spaced apart and are located below port 36. Passageway 38 is disposed proximate port 36 and passageway 40 is disposed proximate the lower end portion 18*a* of elongated body 18. A longitudinal passageway 42 is provided in the wall of elongated body 18 and connects the enclosed ends of passageways 38, 40 to allow communication between passageways 38, 40. Thus, passageways 38, 40, 42 provide, under selective conditions, to be discussed further herein, fluid paths from the central portion of bore 20 to its lower end portion 20*a*.

As best seen in FIGS. 1A, 3–7, valve body 18 is provided with threaded laterally extending ports 30, 32 and 34 which are substantially symmetrically diametrically opposed, in valve body 18, with respect to threaded exhaust port 36 and lateral passageway 38. In the preferred embodiment of FIGS. 3–7, threaded ports 34, 32 straddle either bore 18 or threaded exhaust recovery port 30 and while one selectively communicates with either bore 18 or exhaust recovery port 30, the other selectively communicates with either exhaust recovery port 30 or bore 20 for operational purposes to be described further herein. Ports 32, 34 are "offset" in communicating with bore 20 by passageways 332, 334, respectively. This "offset" nature (as compared to Quartana '773) is to allow the spacing of ports 30, 32, 34 and threading of all such ports for the exhaust recovery means 200 structure and its functions to be described further herein.

Figure 4:
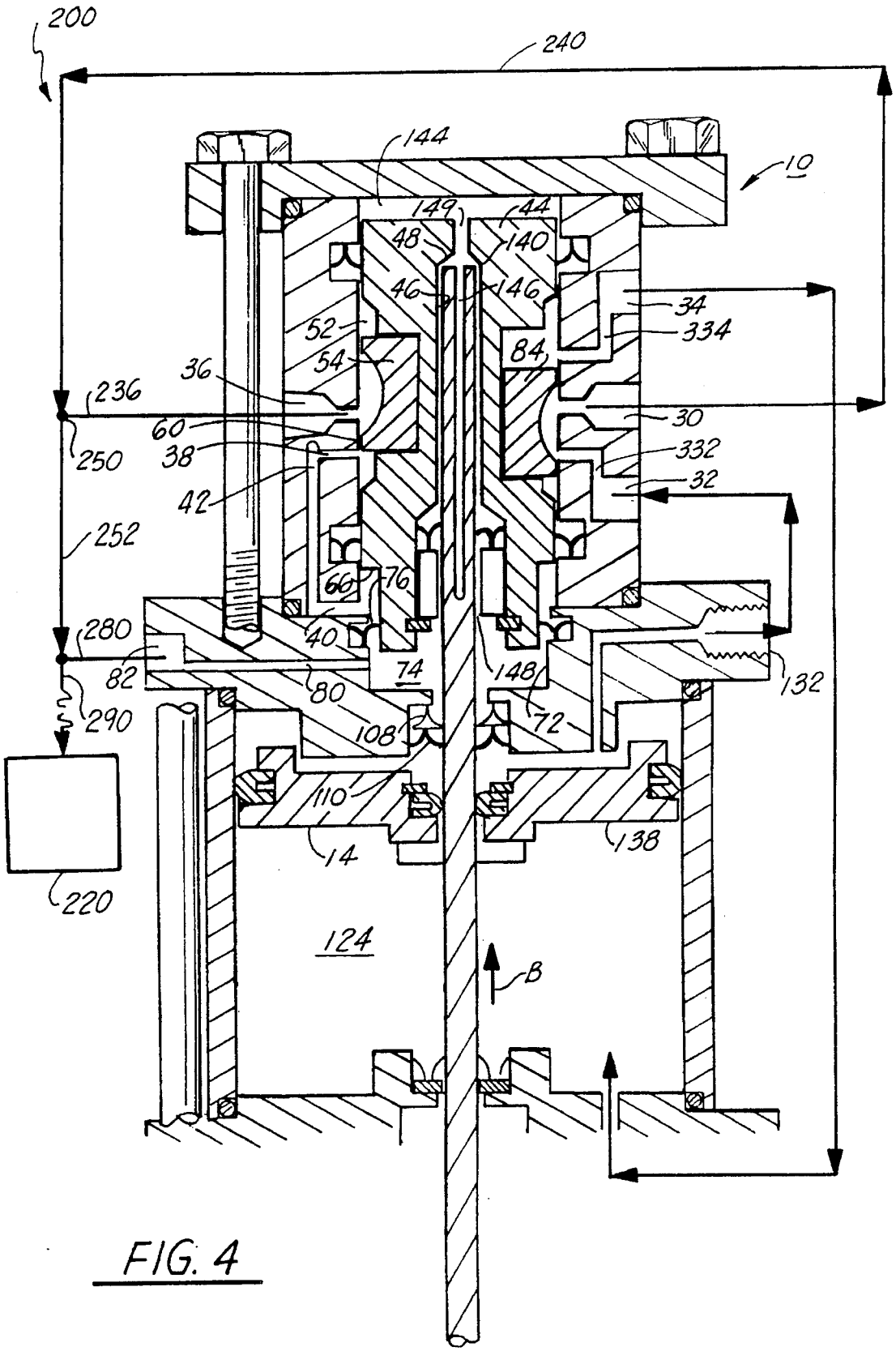
FIG. 4 is a vertical cross-sectional view through the valve of the present invention with the valve member shown shifted to an intermediate position between its downstroke and upstroke positions of FIGS. 3 and 6, respectively; the exhaust recovery means is only schematically illustrated for clarity.
Figure 5:
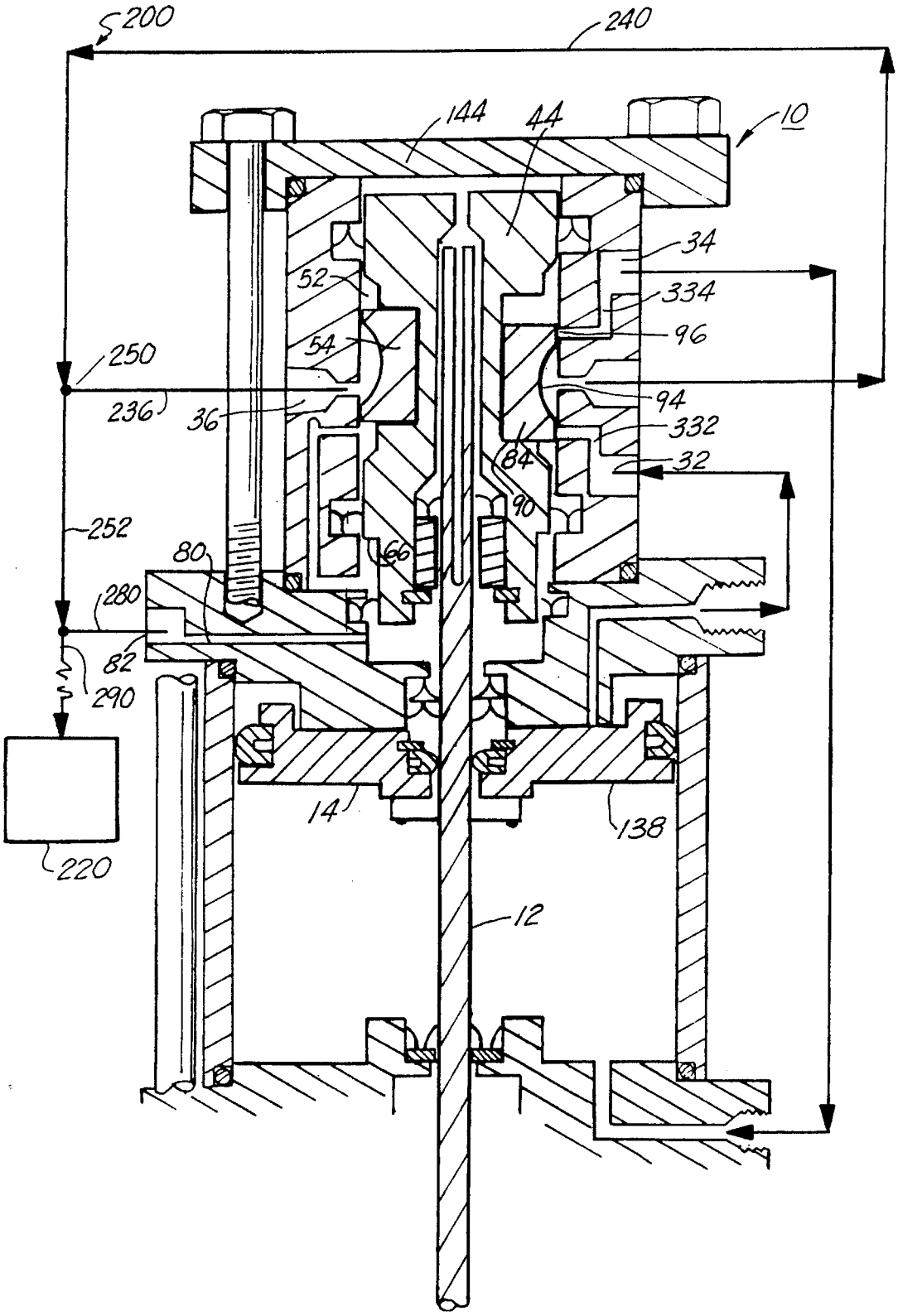
FIG. 5 is a vertical cross-sectional view through the valve of the present invention with the valve member shown shifted to a second intermediate position between its downstroke and upstroke positions of FIGS. 3 and 6, respectively; the exhaust recovery means is only schematically illustrated for clarity.
Figure 6:
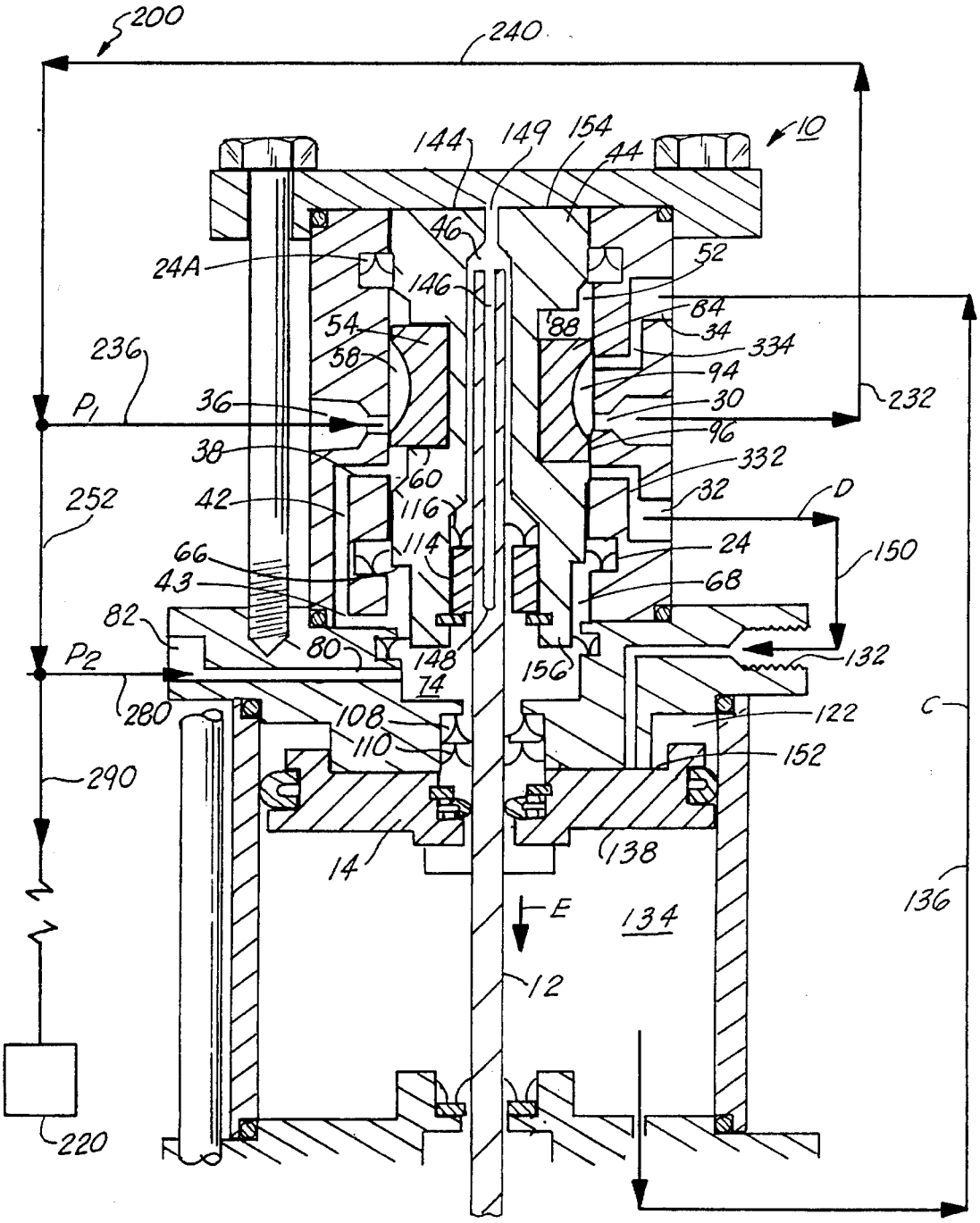
FIG. 6 is a vertical cross-sectional view through the valve of the present invention with the valve member shown shifted to its upstroke position (as that of Quartana, III '773 of FIGS. 2 and 6); the exhaust recovery means is only schematically illustrated for clarity; and, FIG. 7 is a vertical cross-sectional view through the valve and exhaust recovery means of the present invention with the valve member shown shifted to an intermediate position between its downstroke and upstroke positions of FIGS. 3 and 6.
Figure 7:
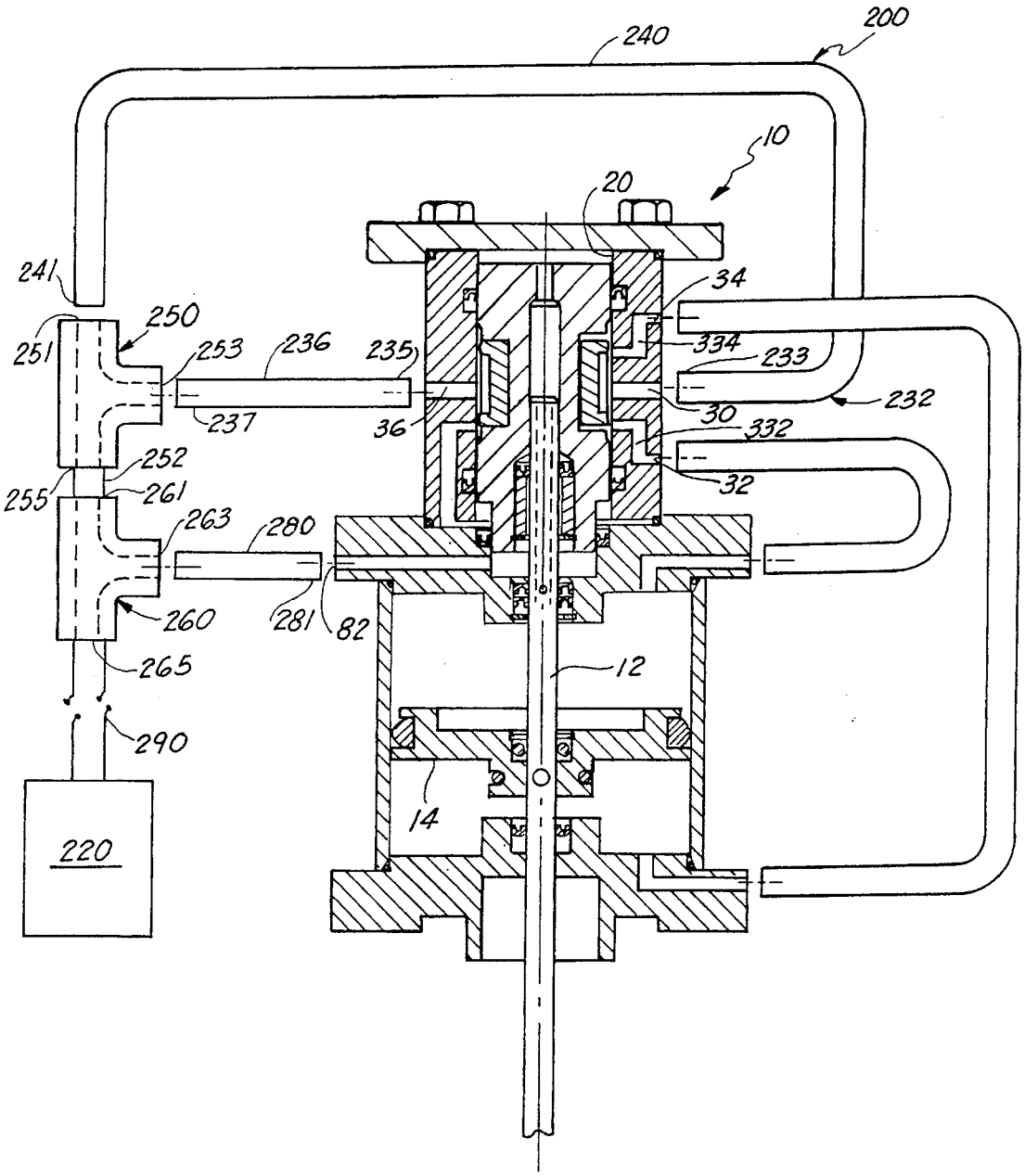

The exhaust recovery means 200 of the present invention, best seen in FIG. 7 and only schematically illustrated in FIGS. 3–6 for clarity, comprises exhaust line 232 threadably connected at its proximate end 233 to threaded port 30 and continuing as line 240, which in turn is threadably connected at its distal end 241 to threaded port 251 of T-fitting 250 which is connected at threaded port 253 to the threaded distal end 237 of exhaust line 236 which is threadably connected at its proximate end 235 to threaded exhaust port 36. T-fitting 250 accepts the exhaust from lines 232,240 and 236 and passes it via threaded port 255, connecting line 252 and threaded port 261 to T-fitting 260 which also accepts exhaust at threaded-port 263 from exhaust line 280 threadably connected at its proximate end 281 to threaded exhaust port 82. The exhaust gas thus collected at T-fitting 260 is passed via line 290 (connected at threaded port 265) to gas recovery reservoir 220. The pressure ARROWS P1 and P2 of FIG. 6 illustrate the back pressure that may exists in the exhaust recovery means 200 under certain conditions, and is meant to be illustrative only in nature.

Figure 3:
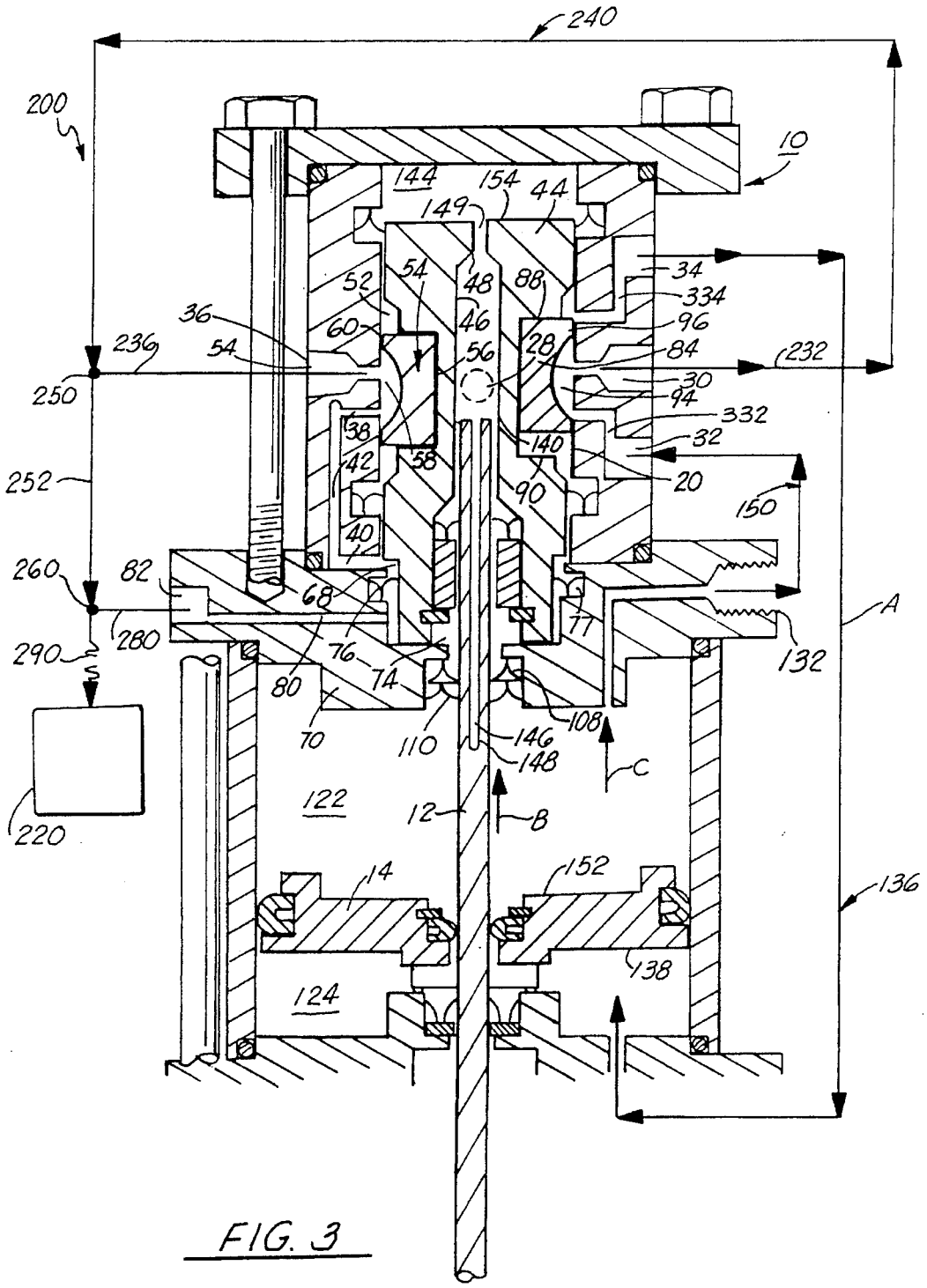
FIG. 3 is a vertical cross-sectional view through the valve of the present invention with the valve member and the actuating piston of the pump shifted to a position at the end of their downstroke and the exhaust tubing schematically illustrated for clarity.

Returning to valve 10 of FIGS. 3–6, body 18 having central bore 20 therethrough slidably receives an elongated cylindrical valve member 44 best shown in FIG. 1B (as also described in Mr. Quartana's U.S. Pat. No. 4,776,773). Valve member 44 is provided with a central longitudinal bore 46 which extends through the body of valve member 44. An annular shoulder 48 is provided in the upper portion of bore 46 proximate the upper end of valve member 44 for forming a pressure surface in bore 146 for purposes as described hereinafter. Valve member 44 is further provided with a reduced cylindrical body portion 50 which extends axially between annular shoulders 51. Valve member 44 is longitudinally movable by means of control fluid from inlet port 28 from a first lower or downstroke position as shown in FIG. 3 to a second upper or upstroke position as shown in FIGS. 2 (of Quartana III '773) and 6 (of the present invention). Between the surface of reduced portion 50 and the surface of bore 20 an annular space 52 is formed. The longitudinal length of reduced body portion 50 is such that the positioning of inlet port 28 in body 18 (shown in phantom in FIGS. 1A and 3) lies between shoulders 51 when valve member 44 and reduced body portion 50 are in either their upper position, lower position or any other position intermediate their upper and lower positions. Inlet 28 is always in communication with annular space 52 in order to communicate pressurized control fluid to annular space 52 where it may be selectively distributed to ports 38, 34 and 32 as hereafter described.

Included with valve member 44 is a slide valve member 54 (as that of Quartana III '773) which is positioned snugly in a slot 56 between the ends of reduced body portion 50. Slot 56 may be formed by making a pair of spaced radial transverse cuts along reduced portion 50 and a longitudinal cut parallel with the axis of valve member 44 between the enclosed ends of the transverse cuts so that the material between the transverse cuts is removed, forming slot 56, best seen in FIGS. 1B and 3–6. As may be appreciated, slot 56 may be formed by any other suitable means such as by injection molding. The length of slide valve 54 is similar to the longitudinal length between the transverse cuts so that the radially extending walls of the cuts form opposed shoulders 59 between which slide valve 54 is snugly located so that slide valve 54 moves concurrently with valve member 44. Hence, slide valve 54 is movable between a lower position shown in FIG. 3 and an upper position shown in FIG. 6 concurrently with valve member 44. Slide valve 54 includes a longitudinal void 58 along its length between lips 60 that extend continually around the arcuate circumference of slide valve 54. Longitudinal void 58 is thus concurrently movable with valve member 44 between a lower and an upper position as shown in FIGS. 3 and 6, respectively.

Threaded exhaust port 36 is located in the wall of elongated body 18 so that it communicates with longitudinal void 58 as it moves between its upper and lower positions. A second narrow longitudinal slot 62 (FIG. 1B) is provided in body portion 50 for providing a means for receiving an alignment screw 63A (FIG. 1A) or pin which extends through a partially threaded radial bore 63B in valve body 18 which prevents valve member 44 from rotating relative to valve body 18, but allows longitudinal movement of valve member 44 within bore 20 for purposes to be described further herein.

Slide valve 54 has a suitable radial thickness when positioned in bore 20 within slot 56 so that continuous lips 60 have a sealing engagement with bore 20 at all times. It is also within the scope of the invention, that slide valve 54 may have a suitable posterior clearance within slot 56 so that pressurized fluid may be communicated to the rear of slide valve 54 so that lips 60 have a sealing engagement with bore 20 by means of a pressure differential between a high pressure in bore 20 and a lower pressure in communication with threaded exhaust port 36 which may be ambient pressure (as is contemplated by Quartana III '773) or an exhaust recovery pressure.

As mentioned, valve body 18 is provided with annular cup seals 24. Seals 24 are located in bore 20 so that seals 24 straddle reduced portion 50 as valve member 44 moves from between its first position shown in FIG. 3 and its second position shown in FIG. 6. As mentioned, cup seals 24 are positioned with their wiper arms providing a sealing engagement between bore 20 and valve member 44 to prevent pressurized fluid in annular space 52 from bypassing seals 24 to either end of valve member 44.

The lower end of valve member 44 has a cylindrical reduced portion 64 which extends from the lower end of valve member 44 to intersect with an annular shoulder 66 which extends radially inwardly and surrounds valve member 44 to provide a pressure surface for purposes as described hereinafter. Reduced portion 64 and shoulder 66 form a second annular space 68 proximate the lower end of valve member 44. Passageway 40 has communication with second annular space 68 in either of the configurations of valve member 44 so that control fluid is selectively communicated to second annular space 68 as described hereafter.

As described in Mr. Quartana's U.S. Pat. No. 4,776,773 and, as best seen in FIGS. 3–6 of the present invention, bottom cap 70 is provided with a counterbore 72 which has a diameter somewhat larger than the outside diameter of reduced portion 64 so that reduced portion 64 slides within counterbore 72. Counterbore 72 extends axially below bore 20 and together with the lower end of valve member 44 forms a chamber 74 when valve member 44 is in its second or upstroke position. A third annular cup seal 76 is positioned in an annular groove 77 surrounding the entrance to counterbore 72. Cup seal 76 is positioned with its wiper arms 78 facing toward second annular space 68, thus preventing fluid flow from annular space 68 to chamber 74. A lateral passageway 80 extends radially outwardly from counterbore 72 into bottom cap 70. Passageway 80 has its distal end in communication with a threaded exhaust port 82. Thus passageway 80 and exhaust port 82 allow chamber 74 to be vented to the ambient pressure surrounding pilot control relay valve 10 or to an exhaust recovery receptacle 220 via line 280, T-fitting 260 and line 290 of exhaust recovery means 200.

Included with valve member 44 is a second slide valve member 84. Slid valve member 84 is located loosely in a second slot 86 in reduced body portion 50 so that slide valve 84 may have certain stationary positions as described hereafter during initial longitudinal motion of valve member 44 in bore 20. Slot 86 is formed similarly as slot 56 and includes opposed shoulders 88, 90 which extend transversely across valve member 44 and a planar rear surface 92 which extends longitudinally between the inmost ends of shoulders 88, 90. Shoulders 88, 90 are spaced apart so that slide valve 84 lies loosely therebetween, allowing valve member 44 to have initial longitudinal motion from its first or second position while allowing slide valve 84 to remain stationary for purposes as described hereafter.

Slide valve 84 includes a longitudinal void 94 along its length between lips 96 which extend continuously around the arcuate circumference of slide valve 84. Slide valve 84 is further positioned in slot 86 so that lips 96 and void 94 are in contact with bore 20. Slide valve 84 is movable between a first or lower position shown in FIG. 3 and an upper or second position shown in FIG. 6. In its first position, as shown in FIG. 3, longitudinal void 94 covers threaded ports 30, 32, thus, allowing communication between ports 30, 32 for venting port 32 through exhaust recovery port 30 to exhaust line 232, 240, 290 to gas recovery reservoir 220, while allowing communication of control fluid by means of annular space 52 to port 34 and preventing port 34 from being vented to exhaust recovery port 30. In its second position shown in FIG. 6, longitudinal void 94 covers and communicates threaded ports 30, 34 for venting port 34 through exhaust recovery port 30 while communicating control fluid by means of annular space 52 to port 32 concurrently with preventing communication between port 32 and ports 30, 34.

Hence, exhaust recovery port 30 is located in the wall of elongated body 18 so that it is in continual communication with longitudinal void 94 as slide valve 84 moves between its first and second positions. Further, the length of longitudinal void 94 and the location of ports 34, 32 in elongated body 18 is such that port 34 is selectively communicated with exhaust recovery port 30 and port 32 is in communication with annular space 52 while communication between ports 32 and ports 30, 34 is prevented when slide valve 84 is in its second position, and port 32 is selectively communicated with exhaust recovery port 30 and port 34 is in communication with annular space 52 while communication between port 34 and ports 30, 32 is prevented when slide valve 84 is in its first position. Slide valve 84 includes a suitable clearance between its posterior surface and planar surface 92 such that control fluid may bias against the backside of slide valve 84, allowing the pressure differential between a higher pressure in annular space 52 from the control fluid and a lower pressure in port 30 to retain lips 96 sealingly with bore 20, thus, preventing communication between annular space 52 and port 30.

In normal operation valve body 18 is provided with an upper end cap 98. Suitable means such as bolts 100 spaced around the periphery of end caps 98, 70 are threadably attached in corresponding threaded portions in bottom cap 70 for attaching the end caps 70, 98 to valve body 18. Annular seals 102, 104 positioned in grooves proximate the ends of valve body 18 provide a sealing engagement between end caps 70, 98 and valve body 18.

Bottom cap 70 includes a bore 106 which is aligned with longitudinal bore 46 of valve member 44. Elongated valve stem 12, as shown in FIG. 2 of Quartana III '773 and FIGS. 3–6 of the present invention, extends slidably through bore 106, chamber 74 and into bore 46. A pair of coaxially aligned cup seals 108, 110 are positioned in a counterbore 112 recessed in the lower portion of bore 106. Cup seals 108, 110 surround shaft 12 with their wiper arms facing the opening of counterbore 112 for purposes which will be described hereafter. Valve stem 12 has a suitable diameter less than the diameter of bore 46 so that valve stem 12 slides within bore 46. A counterbore 114 between the interior walls of cylindrical reduced portion 64 is aligned with bores 46, 74, 106 and has a diameter larger than bore 46, allowing an annular cup seal 116 to be positioned therein proximate shoulder 118 joining bores 46, 114. Counterbore 114 extends inward into valve member 44, thus, allowing cup seal 116 to be positioned proximate shoulder 118. A removable annular spacer 120 is fixedly positioned in counterbore 114 by suitable means such as threads or a pin 121 after the insertion of cup seal 116 in counterbore 114 and retains cup seal 116 in its position proximate shoulder 11. Valve stem 12 passes through cup seal 116 into bore 46 and cup seal 116 is positioned with its wiper arms engaging valve stem 12 and facing bore 46 for preventing fluid from bypassing downward from bore 46 to counterbore 114.

Application of the present invention 10 is described as controlling the fluid signal to an end device such as injection pump 16, but other such end devices may be controlled. Injection pump 16 includes a chamber 122 which is disposed above piston 14 and a chamber 124 which is disposed below piston 14. An annular seal 126 surrounding piston 14 provides a seal between piston 14 and bore 125 of the body of injection pump 16. Piston 14 is fixedly attached to valve stem 12 by a pin 128 so that valve stem 12 moves concurrently with piston 14. An annular seal 130 between piston 14 and valve stem 12 provides a sealing engagement between piston 14 and valve stem 12. A port 132 in communication with chamber 122 communicates with port 32 by means of a tubular line indicated as 150 so that control fluid may be passed through annular space 52, port 32, line 150 and port 132 to chamber 122. A port 134 communicates with chamber 124 and with port 34 by means of a tubular line indicated as 136 so that control fluid may selectively be communicated through annular space 52, port 34, line 136 and port 134 to chamber 124.

It is contemplated in the preferred embodiment that valve member 44 be manipulated slidably in elongated bore 20 or body 18 by a double acting pump 16 by means of pressure differentials and the mechanical movement of valve stem 12 when it is connected to valve member 44 and that such pump 16 be powered and controlled by pilot fluid provided from pilot valve or apparatus 10 or the present invention at exhaust ports 34, 32 as discussed further herein.

In operation, as pilot control relay valve 10 is in the position of FIG. 3 at the end of its downstroke and slide valve 84 is in its first position at the end of its downstroke, pressurized control fluid is communicated in the direction of ARROW A from inlet port 28 through annular space 52, port 34, line 136 and port 134 to chamber 124 to act on under surface or first pressure surface 138 of piston 14 to move piston 14 and valve stem 12, which provide a longitudinal movement means for purposes as described hereafter, upward in the direction of ARROW B. Chamber 122 is in communication with exhaust recovery port 30 by means of port 132, line 150, port 32 and slide valve 84 in its first position communicating void 94 with ports 32, 30 so that port 32 is in communication with exhaust recovery port 30. As piston 14 continues to move upwardly, chamber 122 continues to discharge gas through exhaust recovery port 30 into line 232, 240. Continued upward motion of the longitudinal movement means provided by piston 14 and valve stem 12 will cause upper end portion 140 of valve stem 12 to engage shoulder 48 created by reduced portion 142 of bore 46 and mechanically begin to move valve member 44 and first slide valve member 54 concurrently upwardly in the direction of ARROW B toward the position of FIG. 4. Hence, slide valve 54 provides a precluding means and together with cup seal 24 prevent communication of control fluid from annular space 52 to annular space 68 until lips 60 pass at least partially above port 38, exposing port 38 to control fluid. Since longitudinal void 58 communicates ports 38 and 36, exhaust pressure is communicated by means of exhaust recovery port 36, longitudinal void 58, lateral passageway 38, passageway 42 and lateral passageway 40 to annular space 68 to prevent a vacuum from forming in annular space 68 as valve member 54 moves upward. Thus, valve member 44 has begun its upward stroke independently of slide valve 84 under the influence of stem 12 of the end device such as chemical injection pump 16.

As best seen in the downstroke position of FIG. 3, control pressure provided valve 10 through inlet port 28 communicates through annular space 52 and exits port 34 in the direction of ARROW A to line 136 (to be provided inlet 134 to chamber 124 where the control fluid acts on lower piston surface 138 of piston 14) and port 32 is vented in the direction of ARROW C through exhaust recovery port 30 as slide valve member 84 at lips 96 sealingly engage the wall of bore 20. Port 34 thus communicates with inlet 134 of pump 16 via line 136 to provide control or supply fluid acting on lower surface 138 of piston 14 thereby driving it and thus its stem 12 in the direction of ARROW B in FIG. 3. Hence, slide valve member 84 in its first position, longitudinal void 94, port 34, line 136, port 134 and chamber 124 provide communication means operable when valve member 44 is in its first position and until lips 96 move upward and block port 34, thus halting control fluid from further acting on lower piston surface 138 as discussed hereafter.

After the initial concurrent motion of valve members 44, 54 to an intermediate position between the downstroke and the upstroke positions of valve member 44, slide valve member 54 will have its lips 60 move to a configuration at least partially above passageway 38 as shown in FIG. 4, precluding communication between exhaust recovery port 36 and annular shoulder 66. Thus, control fluid from annular space 52 is communicated through lateral passageway 38, longitudinal passageway 42 and lateral passageway 40 to annular space 68. Cup seal 76 has its arms facing annular space 68 so that pressurized fluid in annular space 68 is prevented from bypassing between seal 78, counterbore 72 and cylindrical reduced portion 64 to chamber 74. Thus, annular shoulder 66 provides a pressure receiving surface which is exposed to pressurized control fluid in annular space 52. Accordingly, slide valve member 54 in its configuration having lips 60 at least partially above passageway 38, passageway 38, longitudinally passage 42, passageway 40 and annular space 68 provide means for communicating control pressure to annular shoulder 66 to shift valve member 44 in its upstroke direction of ARROW B to complete the movement of valve member 44 from its intermediate position of FIG. 5 to its second or upstroke position of FIG. 6.

So that chamber 144 which is formed in bore 20 above the upper end of valve member 44 when valve member 44 is below its upstroke position of FIG. 6 can be vented, valve stem 12 is provided with a longitudinal bore 146 and a port 148. Longitudinal bore 146 extends inwardly from upper end 140 of valve stem 12 and has a suitable depth such that lateral or radial port 148 with which the enclosed end of bore 146 intersects is positioned below seals 108, 110 when valve member 44 is in its first position. Thus, initially chamber 144 is vented by means of restricted bore portion 149 of bore 46 formed by shoulder 48, bore 46, longitudinal bore 146, port 148 chamber 122, port 132, line 150, port 32 and longitudinal void 94 to exhaust recovery port 30 where it is discharged to exhaust recovery pressure via exhaust line 232, 240, T-fitting 250, connector line 252, T-fitting 260 and line 290 to reservoir 220 (some back pressure, indicated by ARROWS P1, P2 in FIG. 6, as exhaust fluid fills T-fittings 250, 260, respectively). After initial movement of valve stem 12 upward to the position shown in FIG. 4, port 148 passes above seals 108, 110 and communicates with chamber 74 below seal 116, thus, allowing chamber 144 to be vented by means of restricted bore portion 149, bore 46, longitudinal bore 146, port 148, chamber 74 and passageway 80 to exhaust recovery port 82 which is in communication with exhaust line 280, T-fitting 260, line 290 and reservoir 220.

After the initial concurrent upstroke motion of valve members 44, 54 passageway 38 has been exposed to control fluid. Further, movement of valve member 44 from its position of FIG. 4 in the direction of ARROW B upward allows lower shoulder 90 to contact slide valve member 84, thus, causing slide valve member 84 to move concurrently longitudinally upward with valve member 44 to a second intermediate position shown in FIG. 5.

The upward motion of slide valve member 84 beyond the position of FIG. 5 will cause lips 96 to cause valve member 44 to quickly switch from the intermediate position of FIG. 4 to the upstroke position of FIG. 6. There will be no halting period at the position of FIG. 5 as suggested by Quartana III '773. The upward motion of valve member 44 responsive to control fluid pressure acting on annular shoulder 66 will continue to vent chamber 144 as described and concurrently move valve members 44, 54, 84 to their upstroke position shown in FIG. 6 thereby moving longitudinal void 94 so that void 94 covers ports 34, 30, allowing chamber 124 to be vented in the direction ARROW C by means of port 134, line 136, port 34 and longitudinal void 94 to exhaust recovery port 30 and hence to exhaust line 232, 240 and eventually reservoir 220.

The movement of slide valve 84 to its second upstroke position moves its lips 96 above port 32, thus, exposing port 32 to control fluid pressure from annular space 52. Thus, longitudinal void 94 when shoulder 90 contact slide valve member 84 moves suddenly relative to ports 32, 30, 34 and "uncovers" port 32 and "covers" ports 30, 34. Thus, control fluid is now provided in the direction of ARROW D by means of annular space 52, port 32, line 150 which communicates port 32 with port 132, and port 132 to chamber 122 and, therefore, to act on upper piston surface os second pressure surface 152 of piston 14 to begin moving piston 14 from its second position as shown in FIGS. 5 and 6 toward its first position. Thus, valve member 84 is included in the precluding means and prevents communication of control fluid to surface 152 until lips 96 are at least partially above port 32, exposing port 32 to control fluid. Control fluid pressure in chamber 124 previously acting on lower piston surface 138 via port 34 and line 136 is concurrently exhausted through exhaust recovery port 30 via port 134, line 136, port 34 and longitudinal void 94 until piston 14 has assumed its first position shown in FIG. 2 (the simultaneous blocking of ports 32, 34 by lips 96 occurs during the movement of slide valve member 84 across ports 32, 34 as shown in FIG. 5, however, this is not critical to the operation of pilot valve 10).

The exhausting of control fluid acting on lower piston surface 138 while concurrently providing control fluid by means of annular space 52, port 32, line 150 and port 132 to chamber 122 where it acts on upper piston surface 152 now causes movement of piston 14 and, therefore, stem 12 in the direction of ARROW E in FIG. 6 to the position of FIG. 2 in which port 148 is again positioned below seals 108, 110 in chamber 122. Hence, control fluid is now provided chamber 122 in the direction of ARROW D via annular space 52, port 32, line 150 and port 132 to communicate in the direction of ARROW F (FIG. 2) with chamber 144 via chamber 122, port 148, bore 146, bore 46 and reduced bore portion 149 thereby causing a greater force to act on a pressure receiving surface provided by upper surface 154 of piston 44 than on its lower surface. Accordingly, slide valve member 84 in its second position, longitudinal void 94, port 32, line 150, port 132, chamber 122, port 148, bore 146, bore 46, and reduced bore portion 149 provide a second equalizing means for equalizing the pressure on upper surface 154 with the pressure from the control fluid in communication with reduced body portion 50 to shift valve member 44 to its first position. Referring to FIG. 2 for details, cup seal 116 prevents communication of control fluid in bore 46 to chamber 74 and chamber 74 is vented to exhaust recovery pressure by means of passageway 80 and exhaust recovery port 82, thus, preventing pressure build up in chamber 74 as reduced portion 64 of valve member 44 moves downward into counterbore 72 as valve member 44 moves toward its first position.

Concurrent downward movement of valve members 44, 54 by control fluid pressure acting on upper surface 154 causes valve members 44, 54 to assume an intermediate position. Hence, longitudinal void 58 is moved to cover lateral passageway 38 and exhaust port 36, thus, exhausting annular space 68 to exhaust line 236 by means of lateral passageway 40, longitudinal passageway 42, lateral passageway 38, longitudinal void 58 and exhaust port 36 and equalizing the pressure acting on shoulder 66 with exhaust recovery pressure. (The blocking of passageway 38 by lips 60 of slide valve member 54 occurs during the movement of slide valve member 54 across passageway 38, however, this is not critical to the operation of pilot valve 10). The pressure exerted on surface 154 of piston 44 is greater than the pressure exerted on shoulder 66 and lower surface 156 of valve member 44 exposed to the pressure in chamber 74, allowing valve 44 to continue to move downward to is first position and subsequently vent the pressure in annular space 68 to exhaust recovery means 200. Further, upper seal 24A need only to seal against flow from a higher pressure in annular space 52 and a lower pressure in chamber 144 (or acting on end 154 of valve member 44) as most of the lower surface area 156 of valve member 44 is exposed to exhaust line 280 by means of passageway 80 and exhaust recovery port 82 (and after lips 60 pass below passageway 38, exposing passageway 38 to exhaust line 280, shoulder 66 is also exposed to exhaust line 280 by means of longitudinal void 58, ports 38, 36). Thus, by virtue of its greater surface area, a greater force acts on end 154 than on the lower end of valve member 44, allowing movement of valve members 44, 54 to their first position of FIG. 3, while the lesser upward force is allowed to act on shoulder 66 until annular space 68 is discharged to exhaust line 280.

Since chamber 74 is always vented to exhaust lines, seal 116 is arranged as mentioned with its wiper arms facing towards bore 46 so that a higher pressure contained in chamber 144 and which is in communication with bore 46 is prevented from passing between seal 116 and valve stem 12 and between seal 116 and the wall of counterbore 114, and as port 148 is positioned below seals 108, 110 in order to provide control fluid pressure via chamber 122 as previously described to upper end 154 of valve member 44, port 148 is likewise prevented from discharging in chamber 74. Since the pressure in chamber 122 must now be sealed from chamber 74 cup seals 108, 110 have their wiper arms facing towards chamber 122 allowing their arms to seal against counterbore 112 and valve stem 12 to prevent fluid from being communicated upward between seals 108, 110 and valve stem 12 and counterbore 112 to chamber 74.

This downward (toward the position of FIG. 3) initial movement of first valve member 44 from its upstroke position of FIG. 2 in the direction of ARROW E in FIG. 6 to an intermediate position (not shown) where upper shoulder 88 contacts slide valve member 84 causing slide valve member 84 to suddenly move after venting or exhausting annular space 68 has transpired as described above, first straddling ports 34, 32 and blocking ports 32, 34 with its lips 96, then as valve members 44, 54, 84 continue to move concurrently downward to their first position of FIG. 3, valve member 84 has its lips 96, moved below port 34, thus, communicating port 34 with annular space 52 while longitudinal void 94 communicate port 32 to exhaust recovery port 30, allowing fluid control pressure contained in chamber 122 to again be discharged as previously described in the direction of ARROW C (FIG. 3) to exhaust line 232 via port 132, line 150, port 32, longitudinal void 94 and exhaust recovery port 30.

Since port 148 is not in communication with chamber 122, pressure in chamber 144, is likewise discharged to exhaust line 232 via reduced bore portion 149, bore 46, bore 146, port 148, chamber 122, (in the direction of ARROW C of FIG. 3) to threaded port 132, line 150, port 32, longitudinal void 94 and exhaust recovery port 30. Further, as previously mentioned, when piston 14 and valve stem 12 repeat their upward motion in the direction of ARROW B (such as in FIGS. 4 and 5), thereby moving port 148 into chamber 74, chamber 144 will remain discharged to exhaust line 280 via reduced bore portion 149, bore 46, bore 146, port 148, chamber 74, passageway 80 and exhaust recovery port 82. Thus, chamber 144, after port 32 is communicated to exhaust pressure, is always in communication with back pressure by means of either first chamber 122 or chamber 74, thus, allowing valve member 44 to be moved from its first position to its second position and yet allow the recovery of exhaust fluid at reservoir 220. Since slide valve member has again uncovered port 34 and exposed it to control fluid, control fluid is again communicated through inlet port 18, annular space 52, port 34, line 136 and port 134 to chamber 123 where it again acts on lower surface area 138 of piston 14.

Pilot control valve 10 now repeats the strokes from right to left and left to right (of FIGS. 3, 4, 5, 6 and 2) following the above method over and over again causing the lower end of valve stem 12 to control the pumping rate of a device such as, for example, injection pump 16.

It is important to note that the movement of slide valve member 54 and, thus, longitudinal void 58 relative to port 36 and passageway 38 is such that exhaust recovery port 36 is always covered or in communication with void 58 and passageway 38 during upstroke motion of valve member 44 is "first bled" before being blocked by lips 60 and then exposed to annular space 52 as lips 60 move above passageway 38, thus, "pressuring up" or equalizing the pressure on shoulder 66 with the pressure of the control fluid in annular space 52. Further, passageway 38 is exposed to control fluid before slide valve member 84 has moved upwardly and its lips 96 have blocked port 34 to halt further upstroke motion of piston 14 and valve stem 12 so that a greater force or upstroke force which is in the direction of ARROW B in FIGS. 3 and 4 is present on valve member 44 to complete the motion of valve member 44 to its second or upstroke position. Before passageway 38 is exposed to control fluid, control fluid pressure in annular space 52 acting on valve member 44 is equalized. However, when passageway 38 is exposed to control fluid, pressure in annular space 68 becomes equalized with the control fluid pressure in annular space 52, thus, offsetting a downward force on lower shoulder 51A, thus, allowing the first greater force or upstroke force to continue the movement of valve 44 to its second position. Since pressure in annular space 68 after passageway 38 is exposed to control fluid will never exceed control fluid pressure, seal 24 need only be a one-way seal to prevent premature communication of control fluid to annular space 68 when passageway 38 is covered by longitudinal void 58 and sealed off from annular space 52 by slide valve member 54.

The length of valve member 44 and bore 20 along with the distance between shoulders 88, 90 may be varied to change the stroke length. With the length of bore 20 and valve member 44 changed, the time and distance under the same control fluid pressure required for a movement of valve member 44 from its first position to its second position and again to its first position will be altered. Further, lengthening the distance between shoulders 88, 90 will slow the rate at which slide valve 84 covers and uncovers ports 34, 32, thus, altering the pumping rate and stroke length. However, with any embodiment constructed according to the present invention, the pumping rate may be selected by merely lowering or raising the control fluid pressure. Thus, a high control fluid pressure will produce a higher pumping rate and a lower control fluid pressure will produce a lower pumping rate. For additional pumping control, a conventional pressure regulator or needle valve (not shown) is inserted in line 150 to regulate the passage of fluid through line 150, thereby allowing precise control over the pumping rate over a very wide range of pumping rates.

It is important to note that the dimensions of slide valves 54, 84 and longitudinal voids 58, 94 be precisely determined relative to the diameters and spacings of port 36 and passageway 38 and ports 34 30, 32.

Thus slide valve member 54 and longitudinal void 58 are dimensioned as follows: longitudinal void 58 to cover exhaust recovery port 36 continually while covering passageway 38 (FIG. 3) while valve member 44 is in its first position and then upon movement of slide valve member 54 in the direction of ARROW B, lips 60 to pass at least partially above passageway 38 to communicate passageway 38 to annular space 52 before lips 96 of slide valve 84 have moved upward to block port 34 to halt further upward movement of piston 14 and valve stem 12, thus, allowing control fluid pressure to continue the movement of valve member 44 to its second position.

Thus, slide valve member 84 and the longitudinal distance between shoulders 88, 90 are as follows: longitudinal void 94 to continually cover exhaust port 30 while selectively covering port 32 when slide valve 84 is in its first position and selectively covering port 34 when valve member 84 is in its first position. Concurrently when valve member 44 is in its first position, lips 96 are to be below port 34, thus, communicating port 34 with annular space 52, and when valve member 44 is in it second position, lips 96 are to be above port 32, thus, communicating port 32 to annular space 52. Further, the dimensioning and positioning of slot 86 is such that shoulders 90 will move lips 96 to block port 34 only after passageway 38 has been exposed to control fluid during upstroke motion of valve member 44 and during downstroke motion shoulder 88 will not engage slide valve 84 so that lips 96 are moved to block port 32 before passageway 38 has been covered by longitudinal void 58 to vent annular space 68 to port 36, thus, allowing control fluid pressure trapped in chamber 144 by the movement of lips 96 to block port 32 to continue the downward motion of valve member 44 to its first position, wherein port 32 is communicated with exhaust recovery port 30 for discharging of chamber 144 to exhaust line 232.

In this way, a pump such as that disclosed in Mr. Quartana's U.S. Pat. No. 4,776,773 and other pumps can reach low pumping rates while at the same time recover exhaust gas under significant back pressure.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A pilot control valve having means for recovering exhaust fluids, comprising:

(a) a valve body having a longitudinal bore therein;

(b) inlet means for communicating control fluid to said bore;

(c) a valve means disposed in said bore and shiftable in said bore between first and second positions thereof, said valve means having position means for communicating said control fluid from said bore to a longitudinal movement means, said longitudinal movement means being disposed proximate said valve means and movable by said control fluid from a first position of said longitudinal movement means to a second position of said longitudinal movement means for contacting a first pressure receiving surface included with said valve means for initially moving said valve means from its first position, said valve means moving to a first position intermediate said first and second positions of said valve means after initial movement of said valve means for communicating said control fluid from said bore to a second pressure receiving surface included with said valve means for moving said valve means to its second position;

(d) exhaust fluid recovery means in fluid communication with said bore in all said positions of said valve means.

2. The pilot control valve of claim 1, wherein said exhaust fluid recovery means comprises:

(a) exhaust ports in said valve body in fluid communication with said bore; and, (b) fluid passageways communicating said exhaust ports with an exhaust fluid reservoir, whereat exhaust fluid discharged from said bore is collected under pressure for further use.

3. The pilot control valve of claim 2, wherein at least one of said exhaust ports is positioned in said valve body intermediate said first and second positions of said longitudinal movement means.

4. The pilot control valve of claim 1, wherein said exhaust fluid recovery means is in fluid communication with said bore in all positions of said longitudinal movement means.

5. The pilot control valve of claim 2, wherein one of said exhaust ports in said valve body is in fluid communication with said bore proximate one of said pressure receiving surfaces of said valve means.

6. The pilot control valve of claim 2, wherein said exhaust ports are radially disposed through said valve body.

7. The pilot control valve of claim 2, wherein one pair of said exhaust ports is radially oppositely disposed through said valve body.

8. A pilot control valve having means for recovering exhaust fluids, comprising:

(a) a valve body;

(b) a longitudinal bore in said valve body;

(c) inlet means for communicating control fluid to said bore;

(d) an elongated valve member having first, second and third pressure receiving surfaces thereon, said valve member being longitudinally slidable within said bore and shiftable between a first and a second position for selectively presenting said first, second and third pressure surfaces to said control fluid;

(e) longitudinal movement means disposed adjacent said first pressure surface and in communication with said control fluid for imparting longitudinal motion to said longitudinal movement means, said longitudinal movement means movable from a first position by said control fluid to a configuration contacting said first pressure surface for imparting initial longitudinal shifting of said valve member from its first position;

(f) precluding means disposed on said valve member for precluding control fluid from communicating with said second pressure receiving surface provided on said valve member when said valve member is in its first position, said precluding means after said valve member shifts from its fist position exposing said second pressure surface to control fluid to equalize the pressure between said control fluid and the pressure on acting on said second pressure surface, said precluding means when said valve member is in its second position communicating said control fluid to said longitudinal movement means for moving said longitudinal movement means to its first position to communicate said control fluid with said third pressure surface for shifting said valve member to its first position;

(g) a greater force on said valve member formed by the equalization of pressure between the pressure of said control fluid and said pressure acting on said second pressure surface for moving said valve member to said second position, said greater force being activatable after initial longitudinal motion of said valve member; and, (h) exhaust fluid recovery means in fluid communication with said bore in all said positions of said valve means comprising:

i. exhaust ports in said valve body in fluid communication with said bore; and, ii. fluid passageways communicating said exhaust ports with an exhaust fluid reservoir, whereby exhaust fluid that is discharged from said bore is collected in said reservoir under pressure for further use.

9. The pilot control valve of claim 8, wherein at least one of said exhaust ports is positioned in said valve body intermediate said first and second positions of said longitudinal movement means.

10. The pilot control valve of claim 8, wherein said exhaust fluid recovery means is in fluid communication with said bore in all positions of said longitudinal movement means.

11. The pilot control valve of claim 8, wherein one of said exhaust ports in said valve body is in fluid communication with said bore proximate one of said pressure receiving surfaces of said valve means.

12. The pilot control valve of claim 8, wherein said exhaust ports are radially disposed through said valve body.

13. The pilot control valve of claim 8, wherein one pair of said exhaust ports is radially oppositely disposed through said valve body.

14. A pilot control valve having means for recovering exhaust fluids, comprising:

(a) a body having a longitudinal bore;

(b) inlet means for communicating control fluid to said bore;

(c) an elongated valve member slidable in said bore and shiftable between first and second positions, said valve member having first, second and third pressure surfaces thereon and including a reduced portion between said opposed pressure surfaces in continuous communication with said inlet means as said valve member moves between its first and second positions;

(d) longitudinal movement means disposed adjacent said first pressure surface and moveable between a first and a second position for moving a pump element connected to said longitudinal movement means and concurrently movable therewith between a first and a second position;

(e) communication means included with said valve member and said bore for communicating said control fluid to said longitudinal movement means when said valve member is in its first position for moving said longitudinal movement means from a first position to move said pump element from its first to its second position, said communication means further communicating said control fluid to said longitudinal movement means when said valve member is in its second position for returning said longitudinal means to its first position and returning said pump element to its first position;

(f) shifting means for moving said valve member from its first position to its second position, said shifting means including said longitudinal movement means moving from its position adjacent said first pressure surface to a position acting on said first pressure surface for communicating said control fluid pressure to initially move said valve member from said first position, said shifting means including equalizing means disposed in said bore and operable after initial motion of said valve member from its first position for equalizing a pressure on said second pressure surface with a pressure from said control fluid in communication with said reduced portion to shift said valve member to its second position;

(g) second shifting means for moving said valve member from its second position to its first position, said second shifting means including second equalizing means disposed in said bore for equalizing a pressure on said third pressure surface with a pressure from said control fluid in communication with said reduced portion to shift said valve member to its first position, said second shifting means further including said first equalizing means, said first equalizing means initially equalizing said pressure acting on said second pressure surface with said pressure from said control fluid in communication with said reduced portion when said valve member is in its second position, said first equalizing means after initial motion of said valve member from its second position further equalizing said pressure acting on said second pressure surface with a pressure which is lower than said pressure from said control fluid; and, (h) exhaust fluid recovery means in fluid communication with said bore in all said positions of said valve means comprising:

i. exhaust ports in said valve body in fluid communication with said bore; and, ii. fluid passageways communicating said exhaust ports with an exhaust fluid reservoir, whereby exhaust fluid that is discharged from said bore is collected in said reservoir under pressure for further use.

15. The pilot control valve of claim 14, wherein at least one of said exhaust ports is positioned in said valve body intermediate said first and second positions of said longitudinal movement means.

16. The pilot control valve of claim 14, wherein said exhaust fluid recovery means is in fluid communication with said bore in all positions of said longitudinal movement means.

17. The pilot control valve of claim 14, wherein one of said exhaust ports in said valve body is in fluid communication with said bore proximate one of said pressure receiving surfaces of said valve means.

18. The pilot control valve of claim 14, wherein said exhaust ports are radially disposed through said valve body.

19. The pilot control valve of claim 14, wherein one pair of said exhaust ports is radially oppositely disposed through said valve body.

20. A pilot control valve having means for recovering exhaust fluids, comprising:

(a) A valve body;

(b) an elongated bore within said body;

(c) an elongated valve member longitudinally slidable within said bore;

(d) inlet means for communicating control fluid to said bore;

(e) first and second fluid outlet means in said body communicating with said bore;

(f) said valve member being selectively shiftable between a first position allowing communication between said inlet means and said first outlet means and a second position within said bore allowing communication between said inlet means and said second outlet means, said valve member having initial motion from its first and second positions and intermediate longitudinal motion between said initial motions from its first and second positions, said valve member selectively presenting first, second and third pressure surfaces on said valve member, said second and third pressure surfaces being selectively exposed to control fluid, said first pressure surface being selectively exposed to a longitudinal movement means disposed in a first position adjacent said first pressure surface for imparting initial longitudinal movement of said valve member from its first position toward its second position, said valve member after its initial longitudinal movement moving to an intermediate position between its first and second positions having a greater total force thereon from said control fluid than on said third pressure surface for further longitudinal motion of said valve member to its second position thereof, said valve member during its intermediate motion precluding further communication between said inlet means and said first outlet means and consecutively communicating said inlet means with said second outlet means as said valve member moves to said second position for communicating said inlet means with said third pressure surface when said valve member assumes its second position and said longitudinal movement;

(g) said first position of said valve member precluding communication from said inlet means to said second and third pressure surfaces;

(h) said second position of said valve member allowing communication from said fluid inlet means to said second and third pressure surfaces for shifting said valve member from its second position to its first position, said second pressure surface including force reduction means for allowing said valve member to shift from its second position responsive to a second greater total force from said control fluid acting on said third pressure surface, said inlet means communicating with said second outlet means for imparting longitudinal movement to said longitudinal movement means to return said longitudinal movement means in its first position and communicate said control fluid to said third pressure surface said valve member during its intermediate motion precluding further communication between said inlet means and said second pressure surface and precluding further communication between said inlet means and said second outlet for block further communication between said inlet means and said third pressure surface; and, (i) exhaust fluid recovery means in fluid communication with said bore in all said positions of said valve means comprising:

i. exhaust ports in said valve body in fluid communication with said bore; and, ii. fluid passageways communicating said exhaust ports with an exhaust fluid reservoir, whereby exhaust fluid that is discharged from said bore is collected in said reservoir under pressure for further use.

21. The pilot control valve of claim 20, wherein at least one of said exhaust ports is positioned in said valve body intermediate said first and second positions of said longitudinal movement means.

22. The pilot control valve of claim 20, wherein said exhaust fluid recovery means is in fluid communication with said bore in all positions of said longitudinal movement means.

23. The pilot control valve of claim 20, wherein one of said exhaust ports in said valve body is in fluid communication with said bore proximate one of said pressure receiving surfaces of said valve means.

24. The pilot control valve of claim 20, wherein said exhaust ports are radially disposed through said valve body.

25. The pilot control valve of claim 20, wherein one pair of said exhaust ports is radially oppositely disposed through said valve body.

26. The pilot control valve of claim 20, wherein one of said exhaust ports is provided intermediate said first and second fluid outlet means.

27. The pilot control valve of claim 20, wherein said first and second fluid outlet means comprise radial and horizontal passageways, said horizontal passageways depending outwardly from said intermediate exhaust port, whereby said first and second fluid outlet means are spaced apart from said intermediate exhaust port.

28. A method for controlling the movement of a first valve means by a second valve means having a bore in communication with a source of control fluid and a plurality of exhaust ports in fluid communication with said bore and fluid passageways communicating with an exhaust reservoir, comprising the steps of:

(a) communicating said control pressure to a longitudinal movement means slidably included with said first valve means and disposed adjacent an elongated slide valve member slidably disposed in said bore of said second valve means for causing longitudinal motion of said longitudinal movement means;

(b) contacting a pressure surface included with said slide valve means with said longitudinal movement means and imparting initial motion to said valve member in a first direction by said longitudinal motion of said longitudinal movement means;

(c) communicating a second pressure surface included with said slide valve member to said control fluid for equalizing the pressure acting on said second pressure receiving surface with the pressure of said control fluid;

(d) communicating said control pressure to said longitudinal means for returning said longitudinal movement means to said first position;

(e) equalizing said pressure acting on said second pressure surface with said pressure of said control fluid for forming a greater force on said slide valve member in the direction of said first direction;

(f) continuing to move said slide valve member in said first direction by forming said greater force on said slide valve member; and, (g) communicating exhaust fluid to said exhaust ports and through said fluid passageways for collection under pressure in said exhaust reservoir.

* * * * *